US011607876B2

(12) United States Patent
Ayala et al.

(10) Patent No.: US 11,607,876 B2
(45) Date of Patent: Mar. 21, 2023

(54) MEDIA CLAMPS WITH ROLLER ON A SWINGARM

(71) Applicant: Hewlett-Packard Development Company, L.P., Spring, TX (US)

(72) Inventors: Arturo Ayala, Vancouver, WA (US); Gene Jones, Puyallup, WA (US); Robert Yraceburu, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 979 days.

(21) Appl. No.: 16/331,604

(22) PCT Filed: Sep. 9, 2016

(86) PCT No.: PCT/US2016/051044
§ 371 (c)(1),
(2) Date: Mar. 8, 2019

(87) PCT Pub. No.: WO2018/048421
PCT Pub. Date: Mar. 15, 2018

(65) Prior Publication Data

US 2019/0202196 A1 Jul. 4, 2019

(51) Int. Cl.

| | |
|---|---|
| ***B41F 21/04*** | (2006.01) |
| ***B65H 5/14*** | (2006.01) |
| ***B65H 29/04*** | (2006.01) |
| ***B41J 13/22*** | (2006.01) |
| ***B41J 11/00*** | (2006.01) |

(Continued)

(52) U.S. Cl.
CPC ..... *B41F 21/04* (2013.01); *B41J 11/0035* (2013.01); *B41J 13/22* (2013.01); *B41J 17/02* (2013.01); *B65H 5/085* (2013.01); *B65H 5/14* (2013.01); *B65H 29/04* (2013.01);
(Continued)

(58) Field of Classification Search
CPC .... B41F 21/04; B41F 21/08; B65H 2404/231; B65H 29/045; B65H 29/125; B65H 2408/111; B65H 2408/112; B65H 2408/113; B65H 2405/581; B65H 2405/5812; B65H 2402/54; B65H 5/14; B65H 5/085; B65H 29/04; B65H 2405/55; B42F 15/066
See application file for complete search history.

(56) References Cited

U.S. PATENT DOCUMENTS 4,158,456 A * 6/1979 Holland-Letz ..... B65H 3/46 271/118
4,627,607 A 12/1986 Ishii
(Continued)

FOREIGN PATENT DOCUMENTS

EP 0574346 A2 12/1993
JP 04-093273 A 3/1992
(Continued)

*Primary Examiner* — Daniel J Colilla
(74) *Attorney, Agent, or Firm* — Brooks, Cameron & Huebsch, PLLC

(57) ABSTRACT

In an example, a clamp may include a chassis, a swingarm disposed on the chassis, a clamp wheel disposed on a first end of the swingarm to engage with a drag portion of the chassis, and an auxiliary bias member to exert a force against the clamp wheel to resist a rotation of the clamp wheel. The force may periodically increase in magnitude.

19 Claims, 5 Drawing Sheets

(51) Int. Cl.
*B65H 5/08* (2006.01)
*B41J 17/02* (2006.01)

(52) U.S. Cl.
CPC .. *B65H 2402/54* (2013.01); *B65H 2404/1442* (2013.01); *B65H 2405/55* (2013.01); *B65H 2405/5812* (2013.01)

(56) References Cited

U.S. PATENT DOCUMENTS

| | | | | |
|---|---|---|---|---|
| 4,852,868 | A | 8/1989 | Fukui et al. | |
| 6,171,225 | B1 | 1/2001 | Nonoyama et al. | |
| 8,123,209 | B2 | 2/2012 | Kubota et al. | |
| 2006/0255528 | A1* | 11/2006 | Okada | B65H 3/5261 271/121 |
| 2007/0102871 | A1* | 5/2007 | Acton | B41J 13/025 271/207 |

FOREIGN PATENT DOCUMENTS

| | | | |
|---|---|---|---|
| JP | 09-002701 | A | 1/1997 |
| JP | 2000344359 | A | 12/2000 |
| JP | 2001-039572 | | 2/2001 |
| JP | 2010032959 | A | 2/2010 |
| JP | 5278805 | B2 | 9/2013 |
| RU | 2087405 | C1 | 8/1997 |

* cited by examiner

MEDIA CLAMPS WITH ROLLER ON A SWINGARM

BACKGROUND

Imaging devices may perform actions on or with media. Imaging devices may print, scan, copy, or perform other actions on or with the media. Further, imaging devices may transport media throughout the imaging device, into or out of the imaging device, or from a first imaging device to a second imaging device or other device. Imaging devices may transport media of different sizes, thicknesses, or materials.

DETAILED DESCRIPTION

Figure 1:
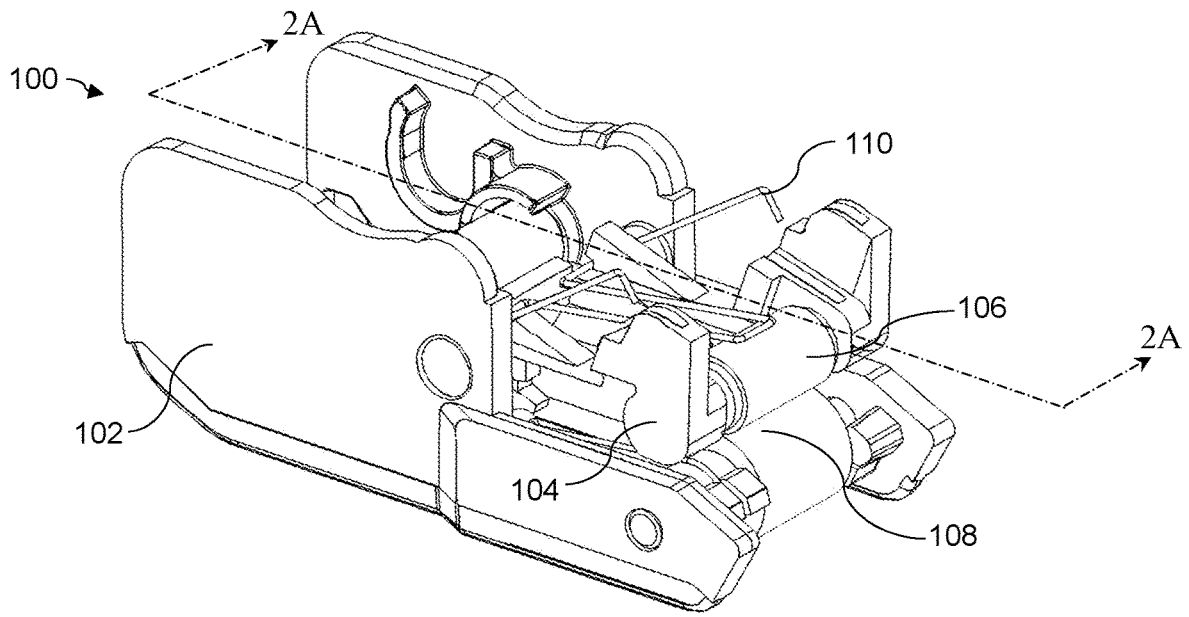
FIG. 1 is a perspective view of an example clamp.

Imaging devices may perform actions on or with media, or a medium thereof. Imaging devices may print, scan, copy, or perform other actions or imaging operations on or with media. In some situations, imaging devices may perform an imaging operation in one portion of the imaging device, then transport media to another portion of the imaging device wherein the imaging device may perform another action on or with the media. As such, imaging devices may transport media throughout the imaging device, into or out of the imaging device, or from a first imaging device to a second imaging device. In some situations, it may be desirable to transport media without damaging the media, and/or without altering or affecting the quality of an imaging operation performed thereon.

In some situations an imaging device may transport different types of media, or media having different characteristics, such as different thickness, size, and/or material. Further, the imaging device may transport media after an imaging operation, such as printing for example, has been performed on or with the media. As such, the imaging device may transport media that has a varying weight and/or surface dryness, and, thus, a varying frictional resistance when transported over surfaces within the imaging device, or other sheets or pieces of media. Therefore, it may be desirable for the imaging device to have a clamp and/or media transporter, or another mechanism, to transport media having a range of weight or frictional resistance without damaging the media, or otherwise affecting an imaging operation performed thereon.

In some situations, imaging devices may include a mechanism to transport media that has a constant retaining force or clamping force. In such a situation, the constant retaining force may be sufficient to retain and transport media of a relatively lighter weight and/or a lower frictional resistance without damaging the media, but may be insufficiently strong enough to transport media having a heavier weight, and/or higher frictional resistance. In other situations, the constant retaining force may be strong enough to retain and transport media of a heavier weight, but may damage thinner media or media of a lighter weight upon the media being pulled or pushed out of the retaining mechanism at the end of the transporting of the media. Thus, in some situations, it may be desirable for the imaging device to have a media transporter with a variable retaining or clamping force, such that the imaging device may transport media of varying weight without damaging the media.

Implementations of the present disclosure provide clamps having a variable clamping force for transporting media, or a medium thereof, within or between imaging devices without damaging the media. Medium may refer to a singular piece or portion of media. Examples of clamps described herein may retain and transport media throughout a media transport path and enable the media to be removed from the clamp at a predetermined location in the media transport path without damaging the media. Further, in some implementations, examples of clamps described herein may retain and transport media with a retaining or clamping force, and may lower the retaining or clamping force before or upon reaching the end of the media transport path such that the media may more easily be removed from the clamp so as to avoid damaging the media upon the media being removed from the clamp.

Referring now to FIG. 1, a perspective view of an example clamp 100 is illustrated. In some implementations, the clamp 100 may transport media within an imaging device, or between an imaging device and another device or imaging device. The imaging device may be a printer, scanner, copier, plotter, or another imaging device or a portion thereof, in some implementations. In further implementations, the imaging device may refer to a component or system engaged with an imaging device, such as a post-processing system, a conditioning system, or a finishing system, or a portion thereof or therebetween.

Clamp 100, in some implementations, may be referred to as a media clamp when engaged with media, or a medium thereof. The example clamp 100 may include a chassis 102, a swingarm 104 disposed on the chassis, a clamp wheel 106 disposed on a first end of the swingarm 104 to engage with a drag portion 108 of the chassis 102, and an auxiliary bias member 110 to exert a force against the clamp wheel 106 to resist a rotation of the clamp wheel 106. In some implementations, the force may periodically increase in magnitude.

Figure 2A:
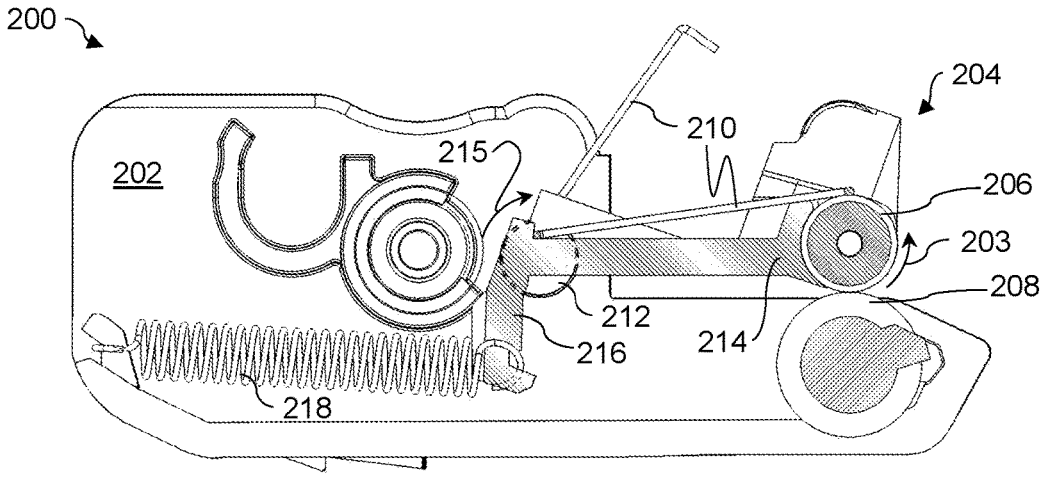
FIG. 2A is a side cross-sectional view of an example clamp.

Referring now to FIG. 2A, a side cross-sectional view of an example clamp 200 is illustrated, wherein the cross-section may be taken along a line similar to line 2A-2A of FIG. 1. Example clamp 200 may be similar to example clamp 100. Further, the similarly named elements of example clamp 200 may be similar in function and/or structure to the elements of example clamp 100, as they are described above. The example clamp 200 may include a chassis 202 having a drag portion 208, a swingarm 204, a clamp wheel 206, and an auxiliary bias member 210. In some implementations, the chassis 202 may be a structural member to engage the clamp 200 with an imaging device, or a track thereof. Additionally, each of the other constituent components of the clamp 200 may be engaged with each other through their respective attachment to or engagement with the chassis 202. In other words, the chassis 202 may be a frame, housing, body, or other suitable component to hold the other clamp components together.

The clamp wheel 206 may be a rotatable component that may rotate or spin relative to the swingarm 204 and the chassis 202. The clamp wheel 206 may be disposed on, or rotatably engaged with, the swingarm 204, or, in some implementations, on a first end 214 of the swingarm 204. The clamp wheel 206 may be disposed on the swingarm 204 such that the clamp wheel 206 may contact or otherwise engage with media that may be disposed under the swingarm 204, or media that may be otherwise disposed, clamped, or retained within the clamp 200. In some implementations, the clamp wheel 206 may be a round or cylindrical component that may spin or rotate along an axis that may be transverse or lateral to a direction along which the clamp 200 may transport media. In further implementations, the clamp wheel 206 may be referred to as a tire or a clamp tire. In yet further implementations, the clamp wheel 206 may include an outer surface with a tacky, sticky, or rubbery texture, or another texture to increase a coefficient of friction of the clamp wheel 206. Such an outer surface may assist the clamp wheel 206 in holding on to or retaining media within the clamp 200.

The swingarm 204 may be a rigid or semi-rigid pivoting arm or member to engage the clamp wheel 206 with the chassis 202. In some implementations, the swingarm 204 may be pivotably disposed on the chassis 202. The swingarm 204 may include a fulcrum 212, the first end 214, and a second end 216. In some implementations, the fulcrum 212 may be disposed in between the first end 214 and the second end 216. The swingarm 204 may be hingeably engaged with the chassis 202 at the fulcrum 212 of the swingarm 204. In some implementations, the fulcrum 212 may act as a pivot between the first end 214 and second end 216, or, stated differently, an action or force exerted on the first or second end of the swingarm 204 may be transferred by the swingarm 204 through the fulcrum 212 so as to result in movement of, or force exerted by, the other end. Thus, force exerted on the second end 216, for example, may be transferred by the swingarm 204 through the fulcrum 212 to result in force being exerted by the first end 214.

In some implementations, the clamp 200 may also include a clamp bias member 218 engaged with the swingarm 204 to bias the clamp wheel 206 towards the drag portion 208. The clamp bias member 218 may be a resilient component that may be elastically deformable. In other words, the clamp bias member 218 may be able to return to its original shape and geometry after undergoing a deformation or deflection. Further, the clamp bias member 218 may exert a reactive force in response to and proportional to a deformation or deflection. In some implementations, the clamp bias member 218 may be a spring, or, more specifically, an extension or tension spring. In other implementations, the clamp bias member 218 may be a different type of spring. In some implementations, the clamp bias member 218 may be anchored to the chassis 202, or another component of the clamp 200 sufficient to fix one end of the clamp bias member 218 relative to the swingarm 204. An opposite end of the clamp bias member 218 may be attached to or engaged with the second end of the swingarm 204, in some implementations, as illustrated in FIG. 2A. Thus, the clamp bias member 218 may be stretched in between the anchor point and the second end 216 such that the clamp bias member 218 exerts a reactive pulling force on the second end 216 of the swingarm 204 to result in a rotational force or torque exerted along a pivoting direction, represented by arrow 215, of the swingarm 204. In other implementations, the clamp bias member 218 may be a compression spring or a torsion spring and may exert a reactive pushing force on the second end 216. In other words, the clamp bias member 218 may bias the swingarm 204 about the fulcrum 212 so as to bias or push the first end 214, or the clamp wheel 206 thereon, towards or against the drag portion 208. Therefore, stated in yet another way, the clamp bias member 218 may urge the swingarm 204 along the pivoting direction 215 relative to the chassis 202 such that the clamp wheel 206 is urged towards the drag portion 208.

In some implementations, the drag portion 208 may be a portion of the chassis 202, or another intermediary component, that may be adjacent to the clamp wheel 206. The drag portion 208, in further implementations, may be a contact point of the clamp wheel 206, and/or may be a point at which the clamp 200 may pinch or clamp media in between the clamp wheel 206 and the chassis 202. Therefore, the clamp 200 may clamp or pinch media in between the clamp wheel 206 and the drag portion 208. Further, in some implementations, the drag portion 208 may include a material that is similar to the material of the clamp wheel 206, for example, a material with a tacky, sticky, or rubbery texture, or another suitable material that may raise a coefficient of friction of the drag portion 208. In further implementations, the drag portion 208 may be a drag wheel, a friction surface, or another component against which the clamp wheel 206 may clamp or pinch media.

The clamp 200 may also include an auxiliary bias member 210. The auxiliary bias member 210 may be engaged with the chassis 202, the swingarm 204, or another suitable component of the clamp 200 such that the auxiliary bias member 210 is positioned to exert a force against the clamp wheel 206. In some implementations, the auxiliary bias member 210 may engage with a top portion of the clamp wheel 206, as illustrated in FIG. 2A. In further implementations, the auxiliary bias member 210 may be directly engaged with the clamp wheel 206, or may be engaged with an intermediary component, wherein the intermediary component is capable of transferring an exerted force from the auxiliary bias member 210 to the clamp wheel 206. In some implementations, the auxiliary bias member 210 may be similar to the clamp bias member 218. In further implementations, the auxiliary bias member 210 may be a different type of spring, such as a torsion spring, compression spring, or a spring having a different structure.

Figure 2B:
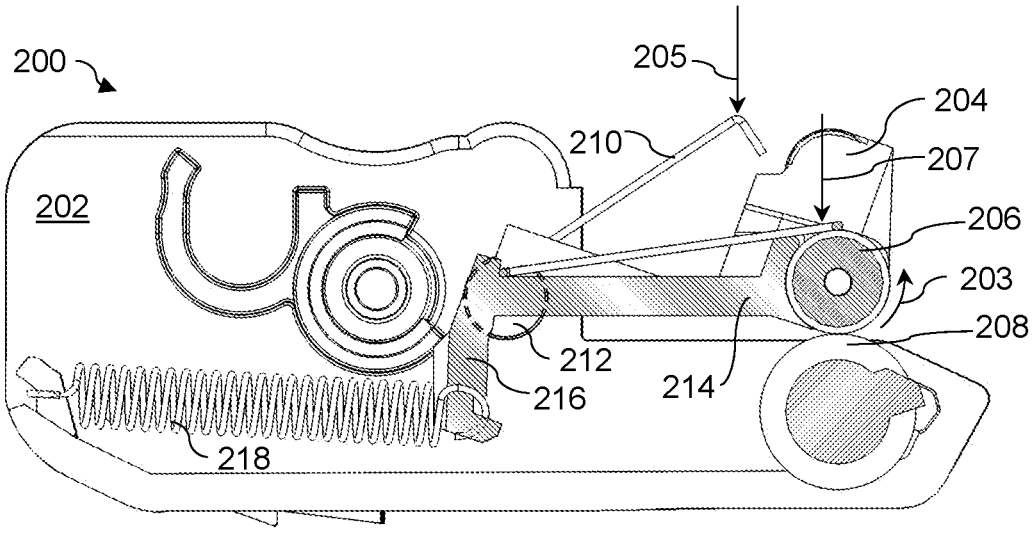
FIG. 2B is a side cross-sectional view of an example clamp.

Referring additionally to FIG. 2B, a side cross-sectional view of clamp 200 is illustrated. In some implementations, the auxiliary bias member 210 may include a first portion to exert a force against the clamp wheel 206, and a second portion to periodically engage with a pressing component. The pressing component may deflect the second portion such that the force exerted by the first portion on the clamp wheel 206 increases in magnitude if the second portion is engaged with the pressing component. In other words, referring to FIG. 2B, a pressing component may engage with or press upon the second portion of the auxiliary bias member 210, represented by arrow 205. The first portion and the second portion of the auxiliary bias member 210 may be structured so that, if the second portion engages with the pressing component, the first portion may exert a force against the clamp wheel 206, represented by arrow 207. In further implementations, the first portion may be under a pretension, or, in other words, may already exert a force against the clamp wheel 206 if the second portion is not engaged with the pressing component. In such a situation, upon engaging with the second portion, the pressing component may further deflect the second portion such that the force 207 already exerted by the first portion increases in magnitude. Force 207 may be exerted against the clamp wheel 206 so as to resist, inhibit, or prevent a rotation 203 of the clamp wheel 206. Such inhibition of rotation of the clamp wheel 206 may prevent media engaged with the clamp wheel 206, or retained by the clamp wheel 206 within the clamp 200, from pulling out of, slipping out of, or otherwise no longer being retained by the clamp 200. Such inhibition of rotation of the clamp wheel 206, in other words, may raise the pullout force needed to remove the media from the clamp 200. In further implementations, the auxiliary bias member 210 may engage with or contact the pressing component periodically, in intervals, or otherwise in a predetermined manner. This may enable the clamp 200 to retain media within the clamp 200 with different levels of force, and may allow the clamp 200 to change the retaining force throughout the transporting of the media.

Figure 3A:
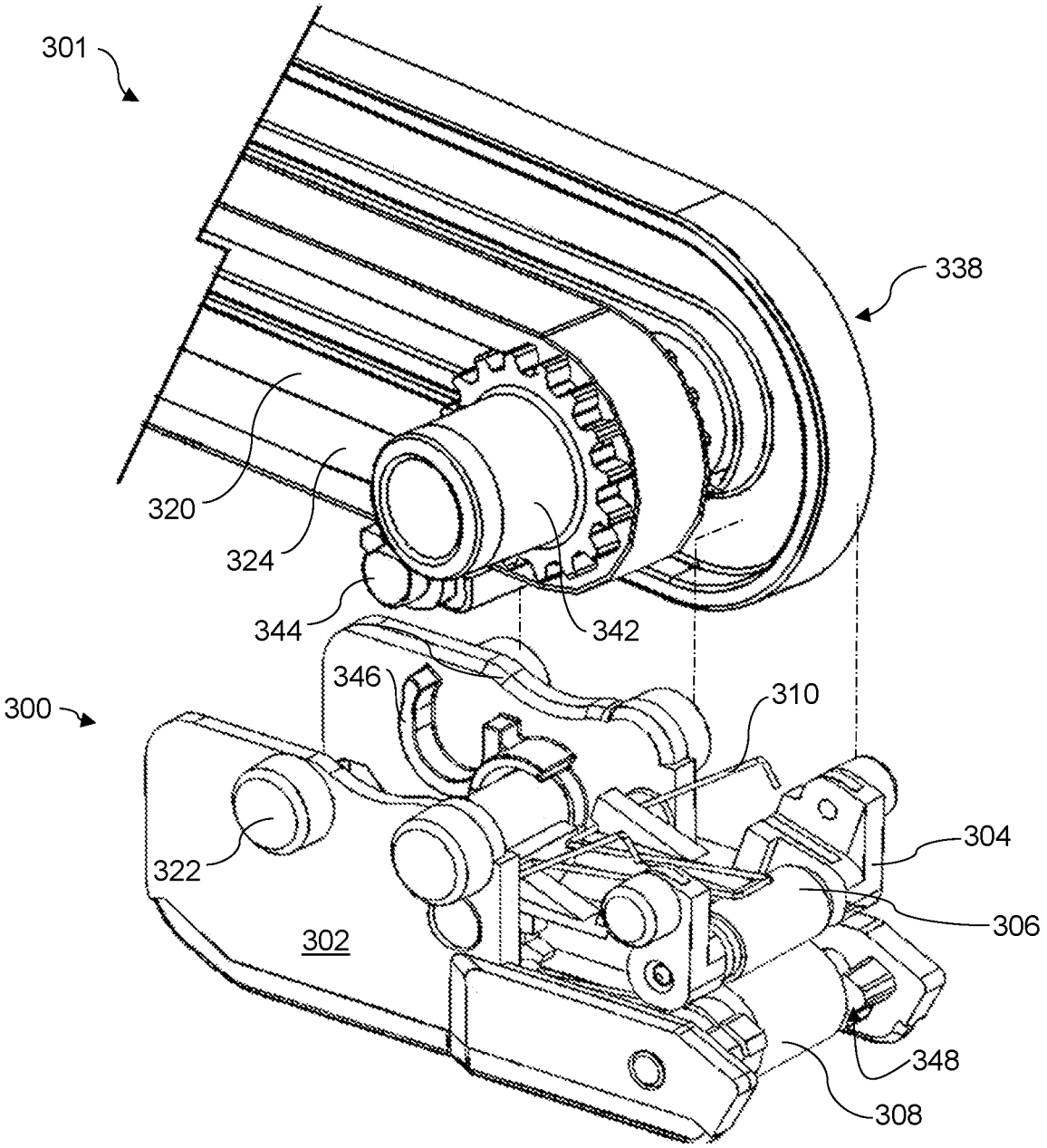
FIG. 3A is a perspective view of an example media transporter including an example clamp.

Referring now to FIG. 3A, a perspective exploded view of an example media transporter 301 having an example clamp 300 is illustrated. Example clamp 300 may be similar to other example clamps described above. Further, the similarly named elements of example clamp 300 may be similar in function and/or structure to the elements of other example clamps, as they are described above. The media transporter 301 may be a part of an imaging device, in some implementations. In further implementations, the media transporter 301 may be part of multiple imaging devices, and may transport media between said imaging devices. In yet further implementations, the media transporter 301 may transport media to, from, or through a device engaged with an imaging device or system, such as a post-processing device, finishing device, or a conditioning device or system.

In some implementations, the media transporter 301 may include a track 338 including a transport path 320, along which the clamp 300 may move or be driven to transport media. The clamp 300 may, thus, engage with the track 338 to transport media along the transport path 320. In further implementations, the transport path 320 may be defined by the track 338, and a second track, not shown, which may oppose the first track 338, such that the first and second tracks adequately support both sides of the clamp 300. In some implementations, the clamp 300 may include a guide 322 to engage with the track 338. The guide 322 may be a post, tab, or other protrusion which may extend out from a lateral side of the clamp 300, or a chassis 302 thereof, and may be sized sufficiently and have an adequate geometry to complementarily engage with the track 320. In some implementations, the guide 322 may enable the clamp 300 to be driven along the track 338, and thus, the transport path 320. In further implementations, the clamp 300 may include multiple guides 322, or enough guides 322 to enable the effective travel of the clamp 300 along the transport path 320. For example, in some implementations, the clamp 300 may include a guide 322 disposed on either lateral side of the clamp 300, each guide to engage with one of the first track 338 or the second track. In further implementations, the clamp 300 may include two or more guides 322 on each lateral side of the clamp 300, as illustrated in FIG. 3A.

In some implementations, the media transporter 301 may include a drive system to drive or move the clamp 300 along the transport path 320. The drive system may include a drive component 342, as well as a transmission component 324, in some implementations. The drive component 342 may be engaged with a motive element, such as a motor or other element capable of transmitting torque to the drive component 342. The transmission component 324, in some implementations, may be a component capable of transmitting movement from the drive component 342 to the clamp 300. In some implementations, the drive component 342 may be a wheel or cog, and the transmission component 324 may be a transport belt, chain, or other suitable component. In further implementations, the transmission component 324 may include a drive lug 344 fixed to the transmission component 324. The drive lug 344 may be a protrusion or other suitable feature engaged with the transmission component 324 such that the drive lug 344 moves with the transmission component 324. In further implementations, the drive lug 344 may engage with a drive cradle 346 within or attached to the clamp 300, or the chassis 302 thereof. The drive lug 344 may move with the transmission component 324 and transfer such movement to the clamp 300. In other words, the transmission component 324, through the drive lug 344, may push or pull the example clamp 300 around or along the transport path 320. In further implementations, the clamp 300 may move along the transport path 320 by a transport belt.

Figure 3B:
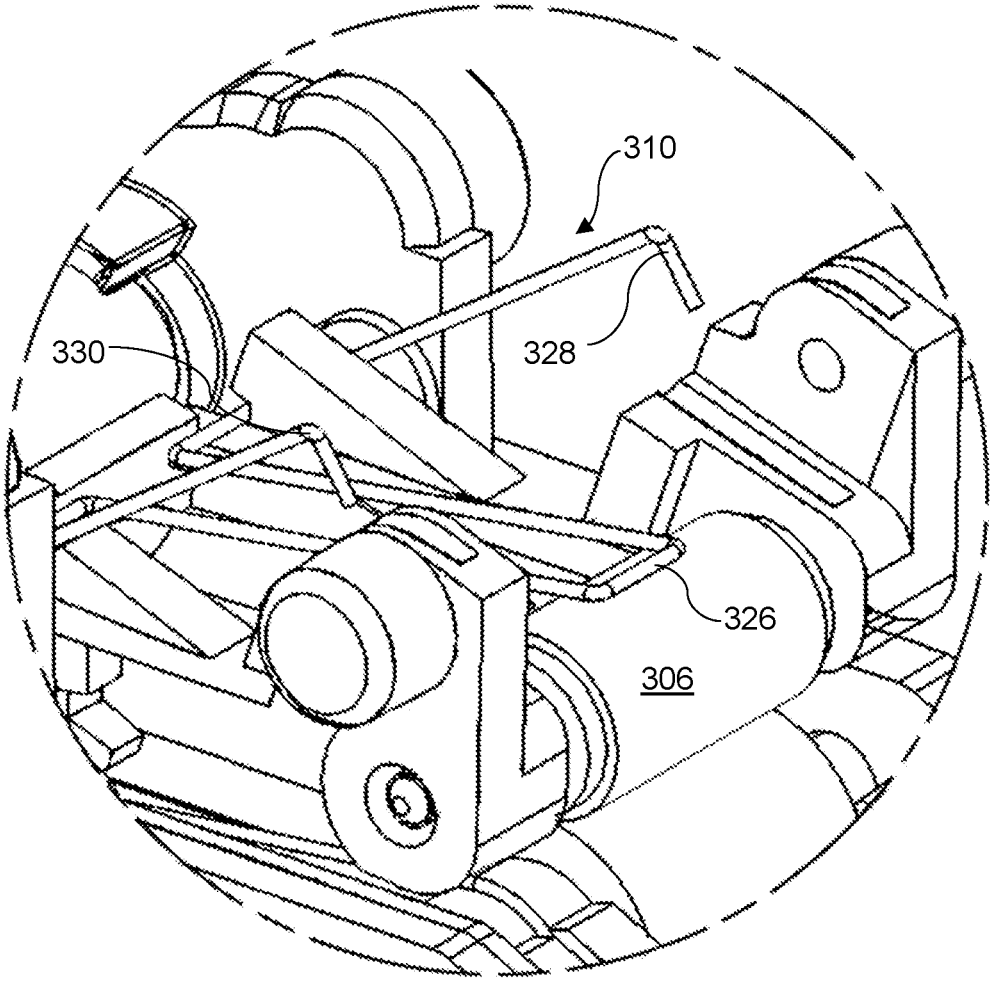
FIG. 3B is a detail perspective view of an example clamp.

Referring now to FIG. 3B, a detail perspective view of the example clamp 300 is illustrated. In some implementations, the clamp 300 may include an auxiliary bias member 310. The auxiliary bias member 310 may include a central arm 326 to engage with a clamp wheel 306, and an outer arm 328 to engage with a rib along the transport path 320. In further implementations, the auxiliary bias member 310 may include a second outer arm 330 to engage with the rib, or another rib, along the transport path 320. The outer arm 328 or arms 328 and 330 and the central arm 326 may be structured such that, if the outer arms 328 and 330 are deflected or deformed, such deflection may result in a reactive force being exerted by the central arm 326, for example, on the clamp wheel 306. As such, the media transporter 301 may include a rib or ribs disposed along the transport path 320 to deflect the outer arms 328 and 330, referred to above as a second portion of the auxiliary bias member, to increase the force exerted by the auxiliary bias member 310 against the clamp wheel 306, thereby increasing the magnitude of a retaining force against media within the clamp 300.

Figure 3C:
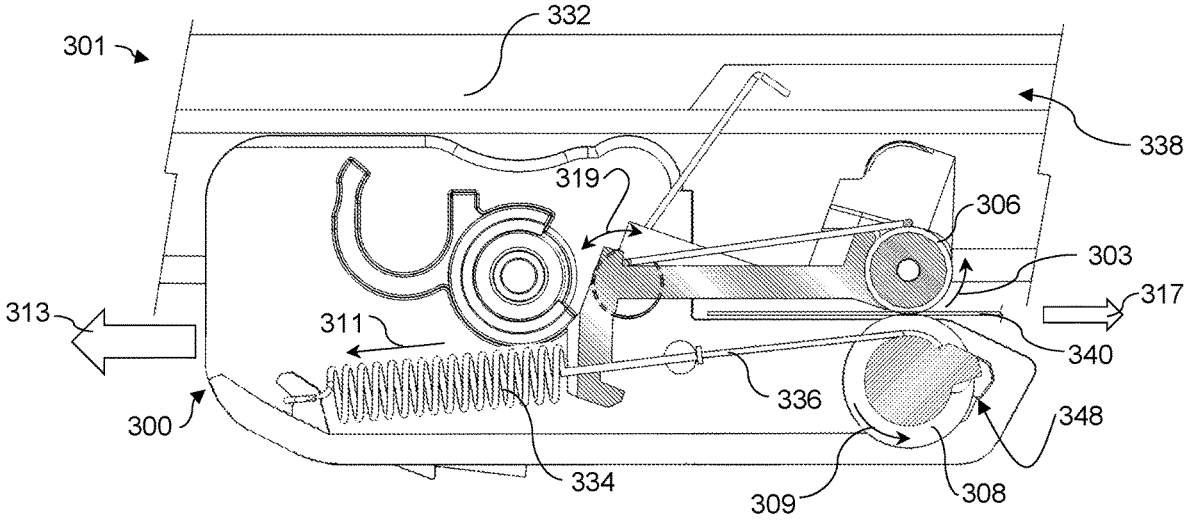
FIG. 3C is a side cross-sectional view of an example clamp.
Figure 3D:
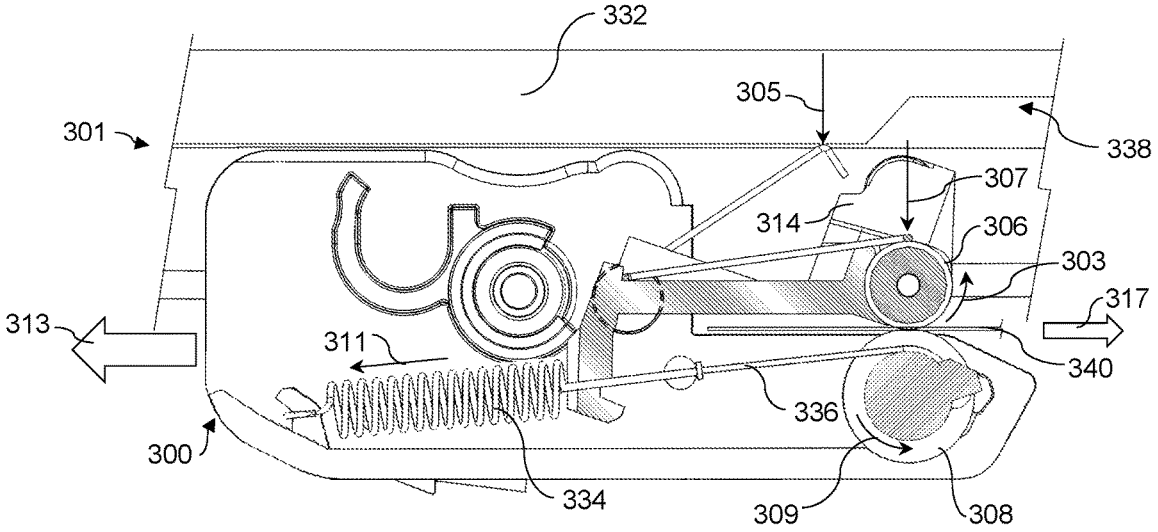
FIG. 3D is a side cross-sectional view of an example clamp.

Referring now to FIGS. 3C-D, side cross-sectional views of the example media transporter 301 and the associated example clamp 300 are illustrated. FIGS. 3C-D illustrate the clamp 300 as being engaged with the track 338 of the media transporter 301, and also being engaged with media 340, or a medium thereof, such that the clamp 300 pinches or clamps the media in between the clamp wheel 306 and a drag wheel 308 to retain the media 340 within the clamp 300. In some implementations, the media 340 may be referred to as a print media. The media 340 may be a suitable material for use with or in an imaging device. In further implementations, the media 340 may be a material that is suitable to have an imaging operation performed on or with the media 340. Such imaging operations may include, but are not limited to, printing, scanning, copying, or other imaging operations. Such suitable materials may include paper, vinyl, latex, cardboard or cardstock, or other suitable materials.

The drag wheel 308 may sometimes be referred to as a drag tire, and may be of similar structure to that of the clamp wheel 306, in some implementations. In other implementations, the drag wheel 308 may be a wheel, cylinder, or another component that may be rotatably engaged with the clamp 300. The drag wheel 308 may be disposed on the chassis 302 of the clamp 300, adjacent to the clamp wheel 306. In further implementations, the clamp 300 may further include a drag bias member 334. The drag bias member 334 may be similar in structure and/or function to the clamp bias member, or other bias members described above, in some implementations. In further implementations, the drag bias member 334 may be an extension or tension spring, and may be anchored on one end to the chassis 302, or another suitable component of the clamp 300. In yet further implementations, an opposite end of the drag bias member 334 may be engaged with the drag wheel 308, such that the drag bias member 334 is stretched between the drag wheel 308 and the anchor point, and thereby exerts a reactive pulling force on the drag wheel 308, represented by arrow 311, so as to exert an inward torque, represented by arrow 309, on the drag wheel 308 to lock the drag wheel 308 against a lock face 348. The torque 309 may resist, inhibit, or prevent an outward rotation of the drag wheel 308, which may be in a direction opposite to arrow 309.

Similarly, the clamp 300 may also include a clamp bias member, not shown, to resist, inhibit, or prevent an outward rotation of the clamp wheel 306, represented by arrow 303, by exerting a pulling force on a swingarm 314, upon which the clamp wheel 306 may be disposed. Therefore, the clamp bias member and the drag bias member 334 may each resist the media 340 moving in an outward direction 317. In further implementations, the drag bias member 334 may be engaged with the drag wheel 308 through an intermediary member, for example, a ball link 336, wherein tension or pulling force in the drag bias member 334 is transferred to the drag wheel 308 through the ball link 336.

In some implementations, in order to transport media 340 along the transport path 320, the swingarm 314 may be moved in an opening direction to receive the media 340, and then in a closing direction to clamp or pinch the media in between the clamp wheel 306 and the drag wheel 308. The opening direction and closing directions may be represented by bidirectional arrow 319 in FIG. 3C. The clamp bias member may pull the swingarm 314, and thus the clamp wheel 306 downwards against the drag wheel 308 in order to pinch the media 340 with a first clamping force. Referring to FIGS. 3C-D together, the clamp 300 may be driven along the transport path 320 in an example direction 313 while the clamp 300 is engaged with media 340, thereby transporting the media 340 along the transport path 320.

In some implementations, the track 338 may include a rib 332 in a predetermined location, or in multiple predetermined locations along the transport path 320. Therefore, as the clamp 300 transports the media 340 along the transport path 320, the auxiliary bias member 310, or an outer arm or arms thereof, may come into contact with, or engage with the rib 332. Upon the auxiliary bias member 310 engaging with the rib 332, the rib 332 may deflect, or further deflect, in some implementations, the contacting portions of the auxiliary bias member 310, as illustrated by arrow 305 in FIG. 3D. Such deflection of the auxiliary bias member 310 may result in the auxiliary bias member 310 exerting a force against the clamp wheel 306, or increasing a force already exerted against the clamp wheel 306 in magnitude, represented by arrow 307. Therefore, when travelling along a portion of the transport path 320 having a rib 332, the media transporter 301, or the clamp 300 thereof, may increase the clamping or retaining force exerted on the media 340 from the first clamping force to a second, higher, clamping force. In other words, the clamp 300 may increase the force necessary to pull the media 340 out of the clamp 300. The media transporter 301, or the clamp 300 thereof may also lower the retaining force exerted on the media 340 by encountering an end to the rib 332, or a gap in the rib 332, in some implementations, along the transport path 320. Such an end or gap may decrease the amount of deflection experienced by the auxiliary bias member 310, thereby lowering the reactive force exerted on the clamp wheel 306 and lowering the resistance to an outward rotation 303 of the clamp wheel 306. The clamp 300 may lower the clamping or retaining force on the media 340 from the second clamping force to a lower clamping force, or back to the first clamping force, in some implementations. In other words, the clamp 300 may retain the media 340 to a greater degree if the auxiliary bias member 310 is engaged with the rib 332 than if the auxiliary bias member 310 were not engaged with the rib 332.

Accordingly, the clamp 300 may lower the retaining or clamping force exerted on the media 340, or lower the necessary pullout force, prior to the media 340 contacting a stationary component in order to be removed from the clamp 300, or at other predetermined intervals or locations along the transport path 320. Increasing the necessary pullout force may enable the clamp 300 to transport media 340 having varying weights, thicknesses, or frictional surfaces, while lowering the necessary pullout force may avoid damage occurring to the media 340 when being pulled or pushed out of the clamp 300.

What is claimed is:

1. A clamp, comprising:

a chassis;

a swingarm disposed on the chassis;

a clamp wheel disposed on a first end of the swingarm to engage with a drag portion of the chassis; and an auxiliary bias member to, configured to be actuated by compression, thereby causing the auxiliary bias member to exert a force against the clamp wheel to resist a rotation of the clamp wheel.

2. The clamp of claim 1, further comprising a clamp bias member engaged with the swingarm to bias the clamp wheel towards the drag portion.

3. The clamp of claim 2, wherein the swingarm is hingeably engaged with the chassis at a fulcrum of the swingarm.

4. The clamp of claim 3, wherein the clamp bias member is engaged with a second end of the swingarm, the clamp bias member to exert a force on the second end and the swingarm to transfer the force exerted by the clamp bias member through the fulcrum so as to bias the clamp wheel towards the drag portion.

5. The clamp of claim 2, wherein the clamp is to clamp media in between the clamp wheel and the drag portion.

6. The clamp of claim 1 in combination with a transport mechanism, the transport mechanism comprising a rib disposed along a clamp transport path, wherein movement of the clamp along the clamp transport path causes an arm of the auxiliary bias member to engage the rib and thereby actuate the auxiliary bias member by compressing the auxiliary bias beneath the rib so as to exert force against the clamp wheel.

7. The clamp in combination with the transport mechanism of claim 6, further comprising multiple ribs disposed along the clamp transport path to periodically actuate the auxiliary bias member during transport of the clamp and exert force against the clamp wheel.

8. The clamp in combination with the transport mechanism of claim 6, wherein the auxiliary bias member comprises two outer arms, both of which engage the rib during transport of the clamp.

9. A media clamp, comprising:

a swingarm pivotably disposed on a chassis;

a clamp wheel disposed on a first end of the swingarm;

a drag wheel disposed on the chassis adjacent to the clamp wheel; a clamp bias member to urge the swingarm in a pivoting direction relative to the chassis such that the clamp wheel is urged towards the drag wheel; and an auxiliary bias member configured to engage with a pressing component that periodically increases a magnitude of a force applied to the clamp wheel by the auxiliary bias member.

10. The media clamp of clamp 9, further comprising a drag bias member to exert an inward torque on the drag wheel to resist an outward rotation of the drag wheel.

11. The media clamp of claim 10, wherein the media clamp is to pinch media in between the clamp wheel and the drag wheel, the clamp bias member and the drag bias member each to resist the media moving in an outward direction.

12. The media clamp of claim 11, further comprising the pressing component, wherein the auxiliary bias member comprises a first portion to exert a force against the clamp wheel and a second portion to periodically engage with the pressing component, the pressing component to deflect the second portion such that the force exerted by the first portion increases in magnitude if the second portion is engaged with the pressing component.

13. The media clamp of claim 10, further comprising a lock face to lock the drag wheel, the drag bias member urging a member of the drag wheel against the lock face.

14. The media clamp of claim 10, further comprising a ball link interfacing the drag wheel and drag bias member.

15. A media transporter, comprising:

a track comprising a transport path; and a clamp to engage with the track to transport media along the transport path, comprising:

a swingarm pivotably disposed on a chassis;

a clamp wheel disposed on a first end of the swingarm;

a drag wheel disposed on the chassis adjacent to the clamp wheel;

a clamp bias member to urge the swingarm in a pivoting direction relative to the chassis such that the clamp wheel is urged towards the drag wheel;

an auxiliary bias member to exert a force against the clamp wheel to resist a rotation of the clamp wheel, the force to periodically increase in magnitude; and a rib disposed along the transport path to deflect a portion of the auxiliary bias member to increase the force exert by the auxiliary bias member against the clamp wheel.

16. The media clamp of claim 15, further comprising the pressing component, wherein the auxiliary bias member comprises a first portion to exert the force against the clamp wheel and a second portion to periodically engage with the pressing component, the pressing component to deflect the second portion such that the force exerted by the first portion increases in magnitude if the second portion is engaged with the pressing component.

17. The media transporter of claim 16, wherein the auxiliary bias member comprises a second outer arm to engage with the rib along the transport path.

18. The media transporter of claim 17, wherein the clamp is to pinch media in between the clamp wheel and the drag wheel to retain media within the clamp.

19. The media transporter of claim 18, wherein the clamp is to retain the media to a greater degree if the auxiliary bias member is engaged with the rib than if the auxiliary bias member were not engaged with the rib.

* * * * *